United States Patent [19]

Hatabe et al.

[11] Patent Number: 4,668,073

[45] Date of Patent: May 26, 1987

[54] FIXING APPARATUS

[75] Inventors: Yukio Hatabe; Yoshio Miyauchi; Masao Fukushima; Toru Horikawa; Yoshihiko Bessho, all of Shiga, Japan

[73] Assignee: Dainippon Screen Mfg. Co., Ltd., Kyoto, Japan

[21] Appl. No.: 730,283

[22] Filed: May 3, 1985

[30] Foreign Application Priority Data

May 4, 1984 [JP] Japan ..... 59-88470

[51] Int. Cl.[4] ..... G03G 15/20

[52] U.S. Cl. ..... 355/3 FU; 219/216; 355/14 FU

[58] Field of Search ..... 355/3 R, 3 FU, 14 FU; 219/216; 432/60

[56] References Cited

U.S. PATENT DOCUMENTS

| | | | |
|---|---|---|---|
| 3,655,280 | 4/1972 | Zoppoth | 355/3 FU |
| 3,716,018 | 2/1973 | Ohta et al. | 355/3 FU X |
| 3,765,828 | 10/1973 | Lux | 355/3 FU X |
| 3,772,497 | 11/1973 | Gray et al. | 355/3 FU X |
| 3,869,612 | 3/1975 | Lenhard | 355/3 FU X |
| 3,900,590 | 8/1975 | Dhoble | 355/3 FU R |
| 4,090,108 | 5/1978 | Johnson et al. | 355/14 FU X |

*Primary Examiner*—Fred L. Braun

*Attorney, Agent, or Firm*—Hayes, Davis & Soloway

[57] ABSTRACT

A photographic fixing apparatus in which photosensitive material to be fixed is fed between upper and lower inclined guideplates, preferably in the form of a plurality of parallel rods, with the lower plate being transparent and with both plates being ventilated to permit the passage of air therethrough. A halogen fixing heater with a quartz filter colored to filter out wavelengths of light to which the photosensitive material is sensitive being provided below the lower guide plate and with a blower being provided to blow air from below the guide plates through the guide plates to maintain photosensitive material passing between the guide plates out of contact with the lower guide plate.

3 Claims, 1 Drawing Figure

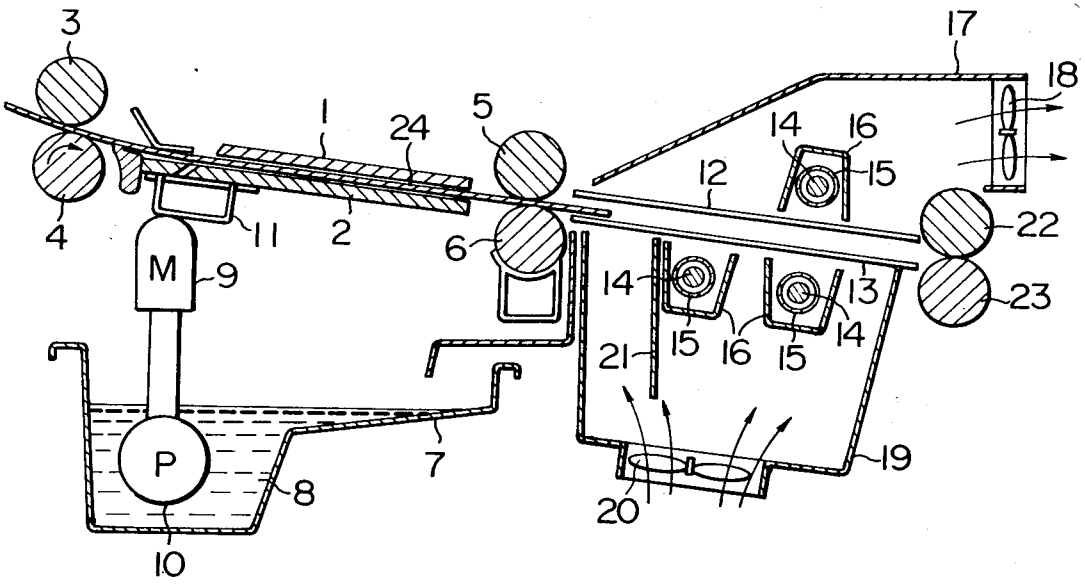
1
2
3
4
5
6
7
8
9
10
11
12
13
14
15
16
17
18
19
20
21
22
23
24
M
P

FIXING APPARATUS

BACKGROUND OF THE INVENTION

The present invention relates to a fixing apparatus in use for producing wetting electronic photographs for preventing irregularities from being occurred at marginal portions of a picture image when an exposed photosensitive material is fixed.

Description of the Prior Art

In the wetting electronic photography of direct type, a photosensitive material is preliminarily electrified, exposed by light rays of a desired pattern configuration and after then developed by a developing liquid containing particles of tone which are electrified with positive charges, whereby the particles of toner are adsorbed by latent picture image areas which are electrified by negative charges. Nextly, after the photosensitive material having been squeezed by squeezing rollers, it is fixed on such as paper base etc., but some quantity of developing liquid is remained.

As the fixing means, conventionally, a heat fixing method by a heating lamp has been conducted for the reason of there being an advantage to rise temperature quickly without pre-heating. In this case negative charges on the photosensitive material are neutralized by dispersed light and heat generated from the heating lamp, so that at those portions from where negative charges are neutralized the particles of toner can not be held any more, and between the picture image areas and the non-picture image areas density gradient basing on the particles of toner is generated, so that diffusion of the particles of toner from the picture image areas to the non-picture image areas begins. Thus, "blurring" or "degeneration" etc. occurs in the picture image, which results in deterioration quality of the picture image.

Conventionally, the above described heat fixing method has been widely applied by disregarding deterioration of quality of the picture image or a method in which a photosensitive material is contacted with a heated plate has been also utilized, so that basing on rising conditions of a heater and contacting conditions with the heated plate, occurrence of fixing unevenness or causing blemishes could not be evaded.

SUMMARY OF THE INVENTION

It is an object of the present invention to eliminate light of which wavelength is in the range of spectrophotosensitive areas of the photosensitive material from lights emitted by the fixing lamp heater with compact means so as to solve the above described disadvantages of the conventional fixing apparatus.

The gist of the present invention is as follows: that is, in a fixing apparatus of a wetting type electronic photograph in which an exposed and having been developed photosensitive material fed to a fixing apparatus by being guided with a transparent guide means is to be fixed by a lamp heater for fixing the developed photosensitive material, light emitted from the lamp heater for fixing the developed photosensitive material is passed through a filter which can eliminate light of which wavelength is within the range of spectrophotosensitive areas, and then the photosensitive material is emitted by the filtrated light, by restraining light of wavelengths within the range of photosensitive wavelength areas from being emitted, or by dropping voltage to be applied to the lamp heater.

BRIEF DESCRIPTION OF THE DRAWINGS

The drawing is a longitudinal sectional view schematically illustrating an embodiment of the present invention together with a developing apparatus.

DETAILED DESCRIPTION OF THE INVENTION AND PREFERRED EMBODIMENT

Hereinafter, referring to the accompanying drawing, one embodiment of the present invention is minutely described.

In the drawing an example of a fixing apparatus in a series of apparatus in which a ZnO photosensitive material is processed by electrifying, exposing, wet developing and fixing by a lamp (halogen lamp) to which the present invention is applied is shown together with a wet developing apparatus in schematically illustrating longitudinal section. In the following description the advancing direction of the photosensitive material is right hand facing to the drawing. Of course, the inverse direction is also applicable.

In the drawing reference numbers (1) and (2) indicate developing plates which oppose top against bottom with each other having slight interval therebetween. At the rearward thereof, that is, at the inlet side there are a pair of a top and a bottom feeding rollers (3) and (4) are disposed, and at the frontward, that is, at the outlet side there are also disposed a pair of a top and a bottom squeezing rollers (5) and (6).

At the lower part of the developing plates (1) and (2) a developing tub (7) in which developing liquid (8) is filled is provided, and the developing liquid (8) in the tub (7) is pumped up with a pump (10) driven by a motor (9) and is to be jetted between the developing plates (1) and (2) through a conduit (11).

At immediately front to the squeezing rollers (5) and (6) there are provided a plurality of branch rods which are inclined at a constant angle with respect to the direction of the photosensitive material being advanced, and guiding plates (12) and (13) which oppose top and bottom relation with a slight interval therebetween are also mounted.

At the upper front part of the upper side guiding plate (12) there is provided a fixing heater (14), and at the lower part of the lower side guiding plate (13) there are provided two fixing heaters (14).(14) arranged in front and in rear. Each of the fixing heaters (14) is a tubular halogen lamp heater and is covered with a colored quartz tube filter (15). Each of the fixing heater (14) is also surrounded by a reflecting plate (16) made of aluminium or stainless steel or the like which has cross section of channel shape and opens in the direction of each of the guiding plates (12) and (13). Accordingly, by the colored quartz tube filter (15), among lights emitted from the fixing heater (14), lights the wavelength of which are shorter than those of spectrophotosensitive areas (shorter than 600 nm) are eliminated therefrom and do not give any influence on the photosensitive material.

The upper side guiding plate (12) and the upper side fixing heater (14) are covered with a covering plate (17). The end portion of the covering plate (17) is inclined to the downward to approximate to the rear end portion of the upper surface of the guiding plate (12) and the other end portion thereof is located at the upper rear end portion of the guiding plate (12). Further, an exhausting fan (18) is mounted at the underside of the front end portion of the covering plate (17).

The underside guiding plate (13) and the two fixing heaters (14).(14) are covered with a covering plate (19) having a channel shpaed side view, and at the bottom portion of the covering plate (19) there is provided an air fan (20).

At the immediately rear portion of the fixing heater (14) positioned at the rear part in the inside of the covering plate (19), there is provided an air introducing plate (21) the upper end portion of which is approximated to the underside guiding plate (13) and the lower end portion of which is disposed at the upper rear end part of the air fan (20).

The air introducing plate (21) serves to guide an air current from the air fan (20) to the air fan (18) so that the air current may be passed through possibly the whole surfaces of the guiding plates (12) and (13) in uniform condition without short cutting it. At the immediate front of the guiding plates (12) and (13), there are provided a pair of top and bottom feeding rollers (22) and (23).

Latent images on a photosensitive material (24) fed between the developing plates (1) and (2) letting its photosensitive surface underside by the feeding rollers (3) and (4) is developed to produce visual images by the developing liquid (8) jetted between the developing plates (1) and (2).

The greater part of solvent of the developing liquid stuck to the photosensitive material (24) is squeezed out by the squeezing rollers (5) and (6), but some of the solvent is remained in stuck condition. Nextly, the photosensitive material (24) is fed between the guiding plates (12) and (13), and by means of air current from the air fan (20), it advances in floating condition without contacting with the underside guiding plate (13).

Meanwhile, the picture images on the photosensitive material (24) are fixed by light emission from the fixing heater (14) and sent out, but among the lights emitted from the fixing heater (14), as mentioned the above, those lights of which wavelengths are in the range of the spectro-photosensitive areas of ZnO are eliminated, so that no influence is given on the photosensitive material (24) at all.

The above described embodiment relates to the fixing apparatus providing a filter, but there is another embodiment in which only thermic rays may be emitted, without emitting light rays the wavelengths of which are in the range of the spectro-photosensitive areas, by dropping voltage to be applied to the fixing lamp. In the above descriptions ZnO photosensitive material is minutely described as a photosensitive material, however, the present invention is never limited thereto, but other photosensitive materials made from such as $TiO_2$, OPC (photoelectric conductor of organic substances) etc. can be also applied to the present invention.

According to the present invention, disturbance at the marginal portions of the picture images on the photosensitive material (24) can be prevented, and explicit and excellent picture quality can be obtained. Further, the fact that the photosensitive material (24) advances in floating condition so that the photosensitive surface of the photosensitive material (24) may not be contacted with the underside guiding plate (13) results in promoting improvement of quality of picture images. In addition, in the present invention a halogen lamp is utilized as a fixing heater, so that rising and/or lowering temperature are quite prompt, which results in high work efficiency. Also voltage to be applied to the lamp can be extremely easily dropped, and further advantage of there no extra cost being necessary.

We claim:

1. A fixing apparatus for immediately producing wetting electronic photographs characterized by a fixing heater which emits light having only wavelengths outside of the range of wavelengths to which spectro-sensitive areas of a photosensitive material are sensitive wherein said fixing heater is a halogen lamp heater having a colored quartz filter, to eliminate light in the spectro-photosensitive wavelength areas of the photosensitive material, located between the lamp and the photosensitive material.

2. A fixing apparatus for immediately producing wetting electronic photographs in which a photosensitive material having been developed is fed therethrough and guided by opposed upper and lower ventilated guiding plates disposed with a space therebetween, and having a fixing heater composed of a halogen lamp the light from which passes through a quartz filter, which filter is colored to prevent wavelengths of light which are within the range of spectro-photosensitive wavelengths of said photosensitive material from reaching the photosensitive material, and having an air blower means to blow air upwardly to maintain the photosensitive material out of contact with the lower guiding plate, said lower guiding plate being transparent and said heater being disposed to heat said photosensitive material through said transparent guiding plate.

3. A fixing apparatus according to claim 2, wherein said guiding plates comprise a plurality of guiding rods inclined with respect to the direction of feeding of the photosensitive material.

* * * * *